United States Patent [19]

Rochlin

[11] 4,281,428

[45] Aug. 4, 1981

[54] FLOATATION PADS FOR LIFE-SAVING VESTS

[76] Inventor: Morris Rochlin, 1220 Morse St., Royal Oak, Mich. 48068

[21] Appl. No.: 122,239

[22] Filed: Feb. 19, 1980

[51] Int. Cl.[3] ..... B63C 9/10

[52] U.S. Cl. ..... 9/342

[58] Field of Search ..... 9/342, 337, 338, 339, 9/340, 341, 329; 156/290, 515, 251

[56] References Cited

U.S. PATENT DOCUMENTS

| | | | |
|---|---|---|---|
| 2,232,640 | 2/1941 | Schwartzman | 156/290 X |
| 3,198,685 | 8/1965 | Kopito | 156/251 X |
| 3,540,067 | 10/1970 | Deruaz | 9/342 |

FOREIGN PATENT DOCUMENTS

| | | | |
|---|---|---|---|
| 273219 | 2/1967 | Australia | 9/342 |

*Primary Examiner*—Trygve M. Blix
*Assistant Examiner*—John C. Paul
*Attorney, Agent, or Firm*—Cullen, Sloman, Cantor, Grauer, Scott & Rutherford

[57] ABSTRACT

Thick floatation pads for securement within the walls of floatation garments, such as life-saving vests and the like, are formed of stacks of aligned, relatively thin, flexible, resilient, foamed plastic sheets which are secured together along at least one edge. The sheets are substantially free of securement, one to another, between their edges. Thus, the sheets may relatively flex, move and bulge relative to each other for closely and comfortably conforming to the shape of the wearer's body and for tending to maintain maximum floatation volume at all times.

2 Claims, 7 Drawing Figures

FLOATATION PADS FOR LIFE-SAVING VESTS

BACKGROUND OF INVENTION

Conventional floatation garments, such as life preserver vests, life jackets and the like, typically are formed of cloth walls shaped to fit around the wearer's torso. Pockets or wall portions are formed to receive and secure floatation blocks. Although at one time blocks were typically made of cork or cork-like material, today these are conventionally made of foam plastic materials which provide bulk, light weight, and because of relatively low specific gravities, produce good floatation results.

By way of example, a typical so called life jacket or life vest which is of a size and shape to fit around a human torso, may be provided with interior pockets or wall areas which contain one inch thick blocks of foamed polyurethane plastics of the closed cell nature. One conventional type of such material is known by the trademark "Ensolite", a product of Uniroyal, which may be used in about a six pound density for life jacket floatation purposes. The sizes and shapes of the blocks vary, depending upon the design of the life jacket or vest, but essentially the floatation material is a thick, e.g. one inch, pad or block of the appropriate height and width.

The conventional floatation blocks, as for example, those described above, are relatively rigid so that they do not drape well around the human body. Moreover, the most useful forms of plastic for this solid or unitary block are typically of a relatively heavy plastic. That is, lighter weight plastics are available, but typically cannot be used because of problems in forming the thick blocks that are needed for floatation purposes.

Because the available plastic materials that are used for floatation block purposes are relatively rigid, life jackets or vests are relatively uncomfortable to wear, particularly for long periods of time. Particularly, the users of such jackets typically feel confined or restricted in their movements. For example, when used by fishermen, canoeists or boaters or the like, more flexibility if desired, but generally not available in conventional block materials.

Thus, the invention herein is concerned with forming what appears to be a conventional floatation block or pad for use in connection with a floatation garment, such as a conventional life jacket or vest, but which is highly flexible, tends to be less compressible to thereby maintain its maximum floatation volume, and may be made of lighter weight plastics.

SUMMARY OF INVENTION

The invention herein contemplates forming a relatively light weight, highly flexible floatation pad or block out of thin sheets of flexible, resilient, closed cell, foam plastic material which are stacked into pad thickness and secured together only along one or more edge portions, so that the sheets are substantially free of positive securement between their edges. Consequently, the sheets may move, flex or bulge relative to each other between their edges to provide unusual flexibility.

The pads of the invention herein may be formed of a much lighter weight plastic material, such as foamed polyethylene, which normally does not drape well or conform to body type shapes when provided in thick blocks. However, when assembled out of thin sheets in the manner described herein, the blocks become highly flexible and resiliently return to original shapes and curves. Moreover, such plastics can be used in a density which is considerably less than available foam plastic blocks used today, as for example, a two pound density polyethylene foam as compared to a typical six pound density "Ensolite" polyvinyl chloride type foam produced by Uniroyal.

An object of the invention herein is to produce pads or blocks which are thick and which can be handled as a unit, as if solid, but which are formed of a stack of sheets which are individually movable relative to each other for enhancing flexibility. Further, the stack of sheets resists compression and tends to remain puffy for maximum floatation volume.

The invention herein further contemplates a simplified fabricated floatation block which can be easily produced with minimal manufacturing and labor costs and which makes it possible to use a wider variety of foam plastics than have previously been practical for such floatation block purpose.

These and other objects and advantages of this invention will become apparent upon reading the following description, of which the attached drawings form a part.

DETAILED DESCRIPTION

Figure 1:
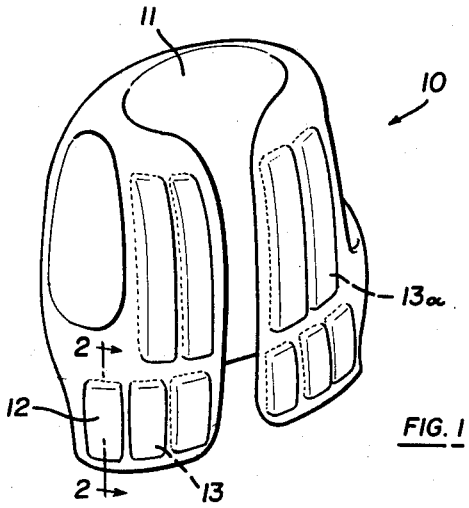
FIG. 1 is a perspective view of a typical life-saving jacket or vest.
Figure 2:
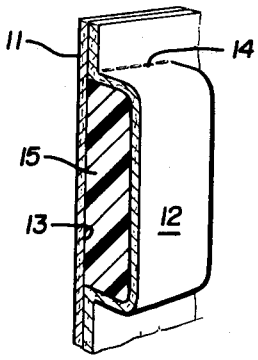
FIG. 2 is an enlarged, cross-sectional, fragmentary view, taken in the direction of arrows 2—2 of FIG. 1, showing a floatation block filler within a pocket formed in the wall of the vest.
Figure 3:
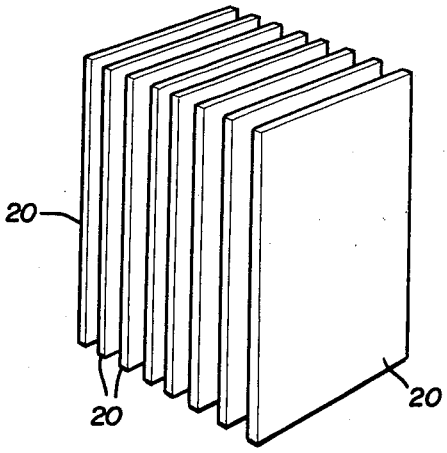
FIG. 3 is a perspective view of a series of sheets aligned for assembly into the floatation block hereof.

FIG. 1 illustrates a typical floatation garment 10 which is in the form of a conventional life vest or life-saving jacket. Although the construction may vary widely, and is of no relevance to the invention herein, the jacket is illustrated as being formed of an inner cloth wall 11 and an outer cloth wall 12 which are stitched together in the conventional manner. Between the cloth walls there are formed numerous small pockets 13 and larger pockets **13*a* which are defined by suitable stitches 14 (see FIG. 2**).

Floatation blocks or pads 15 are arranged within the pockets 13 or are otherwise secured to or within the walls which make up the garment. The invention herein relates to the construction of the floatation blocks rather than the manner in which they are secured to the garment.

Typical unitary floatation blocks or pads which are conventionally used are one inch in thickness and are made of closed cell foamed plastic materials.

The improved floatation block 15 of this invention is made of a stack of numerous sheets 20 formed of a flexible, resilient, closed cell foam plastic material. An example of a useful material for this purpose is polyethylene foam plastic, of about one-eighth inch thickness and about two pounds density. Thus, by way of example, eight, one-eighth inch thick, sheets are arranged together in a stack to form the floatation block or pad 15.

Figure 4:
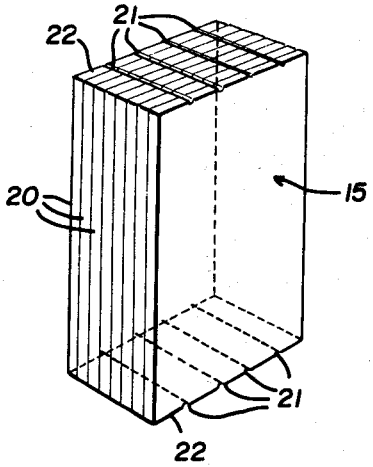
FIG. 4 is a perspective view of a floatation block made of a stack of sheets.

The stack of sheets are secured together along at least one and preferably two opposed edges by means of heat welding or other suitable bonding procedures. FIG. 4 illustrates lines 21 of heat welding which may be applied by pressing a heated wire along spaced lines upon the stack edge. Where heat welding is used, the adjacent sheet portions are bonded together by the welding action or heat sealing.

FIG. 4 illustrates the line type of welding 21 applied to the opposite edges, that is the upper and lower edges 22 of a block 15. The side edges are free of securement and the sheets themselves are free of securement between the opposed edges 22.

Figure 5:
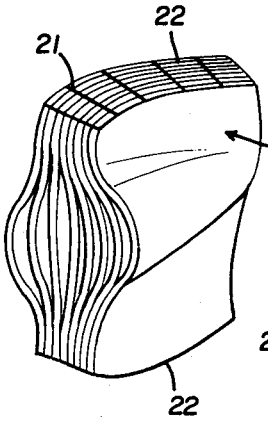
FIG. 5 is a perspective view of the floatation block of FIG. 4, but showing the block twisted or flexed into a shape for conforming to a portion of a human torso.

As illustrated in FIG. 5, because the pads are secured together only at their opposite edges, the respective sheets are free to move or to flex relative to each other so that when the pad is twisted, the sheets tend to separate. Thus, twisting the pad does not result in compression as is the case where a unitary pad is used, which compression would otherwise tend to reduce the floatation volume. Rather, because the sheets separate and individually move relative to each other, they maintain their own individual puffiness and consequently maintain the overall, initial floatation volume.

Since plastic sheet material, such as foamed polyethylene tends to have smooth outer surfaces, which results from the manufacturing procedure, the sheets more easily tend to move relative to one another and to resist compression.

By securing together the opposite edges of the sheets, the block or pad may be handled as a unit both in fabricating the vest, as well as in handling the block itself prior to its being made up into garment constructions.

Figure 6:
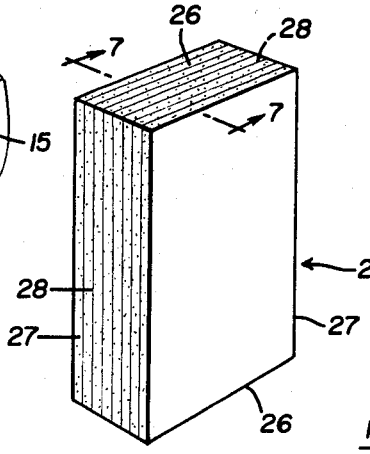
FIG. 6 illustrates, in perspective, a modified form of floatation block, wherein all of the edges are secured together.
Figure 7:
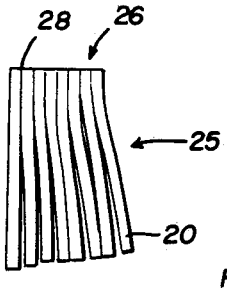
FIG. 7 is an enlarged, fragmentary, cross-sectional view taken in the direction of arrows 7—7 of FIG. 6, showing the bonded or welded upper edge of the block.

For some purposes, it is preferable to bond all of the edges of the block or pad together, leaving the sheets free of securement between their edges. FIG. 6 illustrates a modified form of block wherein the upper and lower edges 26 and the side edges 27 are bonded, as by using a suitable adhesive or bonding agent or by heat sealing or heat welding. For example, by applying a heated plate to the edges 26 and 27, a bonded heat seal or weld 28 if formed thereon, as illustrated in FIG. 6 and in FIG. 7.

Where the edges are bonded together, the sheets are otherwise free or substantially free of securement one to another so that they may still flex an move relative to each other when twisted or formed into body conforming shapes. This form of block 25 is somewhat less flexible than the block 15. However, it is still much more flexible and much more compression resistant than a unitary block construction.

The number of sheets and the thickness of the sheets may be varied as needed to provide an appropriate floatation volume. Thus, a typical block may be fabricated out of eight one-eighth inch thick sheets of foam plastic. However, more or less thinner or thicker sheets may be used to provide the floatation block construction, depending upon the floatation requirements and the available plastic sheet material.

Having fully described an operative embodiment of this invention, I now claim:

1. In a floatation garment, such as a life preserver vest, having walls for fitting around and for being worn by the human body for increasing the water floatation ability thereof, and including relatively thick, foam plastic pads secured to the garment walls, the improvement comprising:

each of said pads being formed of numerous, relatively thin, separate, resilient, flexible, closed cell, polyethylene, foamed plastic sheets arranged in a stack, with one sheet upon another, in face to face contact and all of the sheets being of the same size, so that their edges are in alignment;

at least one edge portion of each sheet being secured to adjacent sheet edge portions of the other sheets in a pad by heat welding so that the sheets are secured together as a unitary pad along at least one edge of the pad, while the sheet portions between the sheet edge are free of positive securement to each other, said heat welding being applied by pressing a heated wire along spaced apart lines upon the one edge of the pad to form spaced apart heat weld lines on said one edge whereby said sheets are secured in face to face contact without being compressed at any point along their lengths;

wherein the pads are like unitary blocks, but are highly flexible and tend to closely drape around adjacent portions of the wearer's body, and the pad portions between the edges thereof tend to be puffy and separately move one from another, rather than to form a tightly compressed unit, to thereby tend to maintain its maximum floatation volume while resiliently conforming to body shape.

2. In a floatation garment as defined in claim 1, and the sheet edge portions at opposite edges of the pad being heat welded together, with their remaining portions of the sheets between said welded edge portions being free of positive securement to one another.

* * * * *